United States Patent [19]

Raphael

[11] 4,311,774

[45] Jan. 19, 1982

[54] IRRADIATION TREATMENT OF POLYMERIC PHOTOGRAPHIC FILM SUPPORTS

[75] Inventor: Thomas Raphael, Winchester, Mass.

[73] Assignee: Polaroid Corporation, Cambridge, Mass.

[21] Appl. No.: 131,873

[22] Filed: Mar. 19, 1980

[51] Int. Cl.[3] ..... G03C 1/78

[52] U.S. Cl. ..... 430/14; 430/10; 430/18; 430/212; 430/227; 430/532; 430/538; 430/523; 430/939; 427/35

[58] Field of Search ..... 430/10, 14, 18, 212, 430/227, 532, 538, 523, 939; 427/35

[56] References Cited

U.S. PATENT DOCUMENTS

| | | | |
|---|---|---|---|
| 3,607,345 | 9/1971 | Thomas et al. | 430/528 |
| 3,630,740 | 12/1971 | Victor et al. | 430/532 |
| 3,679,455 | 7/1972 | Kasugai et al. | 430/532 |
| 3,712,812 | 1/1973 | Van Paesschen et al. | 430/532 |
| 3,746,564 | 7/1973 | Parsons | 430/538 |
| 3,853,585 | 12/1974 | Tatsuta et al. | 430/532 |
| 3,892,575 | 7/1975 | Watts et al. | 430/532 |
| 4,220,471 | 9/1980 | Date et al. | 430/532 |

*Primary Examiner*—Jack P. Brammer

*Attorney, Agent, or Firm*—Robert J. Feltovic; Louis G. Xiarhos

[57] ABSTRACT

A process for heat-stabilizing polymeric supports for diffusion transfer photographic image-receiving elements. Such treatment eliminates distortion effects in these image-receiving elements when they are exposed to high temperatures, such as encountered in ID card lamination devices.

13 Claims, No Drawings

IRRADIATION TREATMENT OF POLYMERIC PHOTOGRAPHIC FILM SUPPORTS

Many commercial identification (ID) card systems are based on cards or documents comprising color photographs from diffusion transfer photographic film units. Such ID diffusion transfer photographs usually contain a photograph of the bearer together with corresponding photographic information. Notably, diffusion transfer photographs are extensively used in ID card issuance systems wherein the intended bearer of the ID card reports to an ID card issuance station where appropriate photographic materials and equipment are assembled. A data card containing information relating to the bearer is prepared and the bearer and the data card are photographed simultaneously with a camera unit employing diffusion transfer photographic film. After processing, a diffusion transfer print is provided which comprises a suitable support carrying an image-bearing layer containing a photograph of the bearer, as well as a photographic reproduction of the information on the data card. A finished ID card is produced by laminating the image-bearing layer of the print to a protective plastic sheet material; most often, the transfer print is sandwiched between two protective plastic sheets. If lamination equipment is not available at the photograph production site for "on-the spot" ID card issuance, multiple prints may be collected and shipped to a remote central lamination station.

Diffusion transfer photographic film units so employed are available from Polaroid Corporation under the trademark designation Polacolor 2. Essentially, such film units comprise a photosensitive element that can provide an image-wise distribution of diffusible image-dye providing materials, after exposure and after application of a processing composition between the photoexposed element and a superposed image-receiving element. Once development is complete, the photosensitive element and image-receiving element are peeled away and the image is viewed in the image-receiving layer of the image-receiving element.

As discussed above, in forming an ID card it is common practice to seal the identification document between two sheets of protective material. A favored structure for fully protecting the front and rear of an ID card is to seal it within an envelope-type pouch. This typically is accomplished by providing a pouch structure including front and back protective sheet members presealed along a portion of the peripheral edge and affording an open portion adapted to receive a photograph-bearing ID document.

Following positioning of the ID card element between two protective sheets, or, following insertion of the ID card into a pouch unit, the laminar structure is bonded together by heat sealing. In the most preferred embodiment, the protective sheets or pouch units have dimensions slightly greater than that of the ID card, so that the peripheral edges of the front and back protective members can be sealed together during the heat lamination procedure. A preferred heat-sealable material for utility as protective sheet material is rigid or semirigid vinyl, e.g., the polyvinyl chloride or polyvinyl chloride-polyvinyl acetate copolymers widely known in the art. Typical structures used in forming ID card structures are illustrated, for example, in U.S. Pat. Nos. 3,949,501 and 3,582,439.

Image-receiving elements employed in diffusion transfer processes that produce color ID photographs generally comprise a plurality of layers coated on one surface of a support film. In addition to the actual image layer, the image-receiving element may further comprise a polymeric acid layer and a time modulating or spacer layer, as well as an overcoat stripping layer, as is more fully described, for example, in U.S. Pat. No. 4,009,031 to Carlson et al.

The image-receiving element used in these processes generally comprises an opaque or transparent support coated with an image-receiving layer of a dyeable material which is permeable to the alkaline processing composition. The dyeable material may comprise polyvinyl alcohol together with a polyvinyl pyridine polymer. Such image-receiving layers are further described in U.S. Pat. No. 3,148,061 issued to Howard C. Haas.

In Polacolor 2 film, the image-receiving layer comprises a mixture of polyvinyl alcohol and poly-4-vinyl pyridine. The image-receiving layer of Polacolor 2 photographic prints additionally includes on its surface a residue of a stripping layer which was used to facilitate peeling apart the photosensitive element from the image-receiving element. This stripping layer is formed by coating a solution of ammonia and a hydrophilic colloid (usually gum arabic).

As disclosed in, for example, U.S. Pat. No. 3,362,819, the polymeric acid neutralizing layer may comprise a nondiffusible acid-reacting reagent adapted to lower the pH from a first (high) pH of the processing composition to a predetermined second (lower) pH. The acid-reacting reagents are preferably polymers which contain acid groups, e.g., carboxylic acid and sulfonic acid groups which are capable of forming salts with alkali metals or with organic bases or potentially acid-yielding groups such as anhydrides or lactones. Preferably the acid polymer contains free carboxyl groups. As examples of useful neutralizing layers, in addition to those disclosed in the aforementioned U.S. Pat. No. 3,362,819, mention may be made of those disclosed in the following U.S. Patents: Bedell U.S. Pat. No. 3,765,885; Sahatjian et al. U.S. Pat. No. 3,819,371; Haas U.S. Pat. No. 3,833,367; Taylor U.S. Pat. No. 3,754,910 and Schlein U.S. Pat. No. 3,756,815.

A spacer or time modulating layer may be and is preferably disposed between the polymeric acid layer and the image-receiving layer in order to control the pH reduction so that it is not premature and hence will not interfere with the development process, e.g., to "time" control the pH reduction. Suitable spacer or "timer" layers for this purpose are described with particularity in U.S. Pat. No. 3,362,819 and in others, including U.S. Pat. Nos. 3,419,389; 3,421,893; 3,433,633; 3,455,686; 3,575,701; 3,785,815 and 3,856,522.

The support for the image-receiving layer may comprise any suitable material including conventional rigid or flexible materials such as paper, resin-coated papers and polymeric films of both synthetic types and those derived from naturally occurring products. Such materials include paper; polyolefin-coated papers, such as polyethylene and polypropylene-coated papers; polymethacrylic acid, methyl and ethyl esters; vinyl chloride polymers, polyvinyl acetal; polymeric resins such as polyethylene; polyamides such as nylon; polyesters such as polymeric films derived from ethylene glycol terephthalic acid; and cellulose derivatives such as cellulose acetate, triacetate, nitrate, propionate, butyrate, acetate-propionate, or acetate-butyrate.

Traditionally, the preferred support material for the image-receiving layer has been paper, more particularly baryta paper. This paper actually is a paper base coated with a layer or layers of baryta ($BaSO_4$) suspended in a small amount of a gelatine solution. Baryta paper, such as used in Polacolor 2 film, typically comprises a 5.0 mil (0.13 mm) paper stock coated with two layers of $BaSO_4$ to a total thickness of 0.5 mil (0.01 mm).

In recent years, the use of polymeric sheet materials and in particular the use of polymeric resin-coated paper products as an image-receiving element support has become widespread. These polymeric materials offer economic incentives while achieving advantageous properties for photographic supports, such as improved whiteness, wet strength and reagent imperviousness. Resin-coated paper, in particular polyethylene coated paper, has become widely used. Polyethylene-coated paper, such as used in Polacolor 2 film typically comprises a 5.0 mil (0.13 mm) thick, high strength paper coated on each side with a white, $TiO_2$-pigmented layer of polyethylene having a thickness of 2.0 mil (0.05 mm).

Along with the advantages, such as those recited, however, polymeric and polymeric resin-coated support material also has introduced a problem to diffusion transfer photography, at least in regard to the use of diffusion transfer prints in ID card preparation. As discussed above, in forming an ID card structure, a diffusion transfer print is laminated to a protective plastic sheet, and, most preferably, is sandwiched between two sheets of plastic material, commonly in the form of a pouch unit. These ID card structures typically are sealed in a heat lamination device. The problem encountered with prints based on a support containing a polymeric material is that at high lamination temperatures, the polymeric resin of the support begins to soften causing distortion of the image appearing on the image-receiving layer of the diffusion transfer print. Common polyethylene-containing photographic support material begins to noticeably distort at about 250° F. (121° C.). Such distortion is unacceptable in ID cards, since the purpose of the card is destroyed by nonclarity of the bearer's image or the essential identification information. Notably, in forming a typical ID card structure wherein a vinyl front sheet member is sealed to a vinyl back sheet member by heat lamination, temperatures ranging above about 300° F. (149° C.), generally from about 325° F. to about 375° F. (163°–191° C.), are required.

It has now been discovered, according to the present invention, that radiation treatment of a polymeric support of a diffusion transfer image-receiving element effectively stabilizes the support material to eliminate heat distortion effects in a diffusion transfer print during ID card lamination procedures.

Radiation treatment effects cross-linking in the polymeric resin material; cross-linking of the polymer chains forms a material with increased resistance to the effects of high temperatures. Accordingly, any polymeric material susceptible to cross-linking is suitable for effective treatment according to the present invented process. The use of polyethylene materials, such as polyethylene clad paper, is preferred.

Apparatus and methods for cross-linking polymeric compositions by subjecting them to suitable forms of radiation are well known in the art and any such irradiation process can be used in carrying out the present invention. The term "irradiation," as used herein, refers to high energy radiation and/or secondary energies resulting from conversion of electrons or other particle energy to x-rays or gamma radiation.

A preferred practice of the invention involves the use of irradiation that has been referred to in the prior art as "ionizing radiation," which has been defined as radiation possessing an energy at least sufficient to produce ions or to break chemical bonds and, thus, includes also radiation such as "ionizing particle radiation" as well as radiations of the type termed "ionizing electromagnetic radiation."

The term "ionizing particle radiation" has been used to designate the emission of electrons or highly accelerated nuclear particles such as protons, neutrons, alpha-particles, deuterons, beta-particles, or their analogs, directed in such a way that the particle is projected into the mass to be irradiated. Charged particles can be accelerated by the aid of voltage gradients by such devices as accelerators with resonance chambers, Van der Graaff generators, betatrons, synchrotons, cyclotrons, etc. Neutron radiation can be produced by bombarding a selected light metal such as beryllium with positive particles of high energy. Particle radiation can also be obtained by use of an atomic pile, radioactive isotopes or other natural or synthetic radioactive materials.

"Ionizing electromagnetic irradiation" is produced when a metallic target, such as tungsten, is bombarded with electrons of suitable energy. This energy is conferred to the electrons by potential accelerators of over 0.1 million electron volts (mev.). In addition to irradiation of this type, commonly called X-ray, an ionizing electromagnetic irradiation suitable for the practice of this invention can be obtained by means of a nuclear reactor (pile) or by the use of natural or synthetic radioactive material, for example, Cobalt 60.

Due to considerations of convenience and economy, a source of accelerated high energy electrons is the preferred means of irradiation. Various types of high-power electron linear accelerators are commercially available. Typically, an electron beam will be provided as a single-point electron beam or in the form of a curtain from a wire filament electron source. Examples of commercially available sources of such ionizing irradiation include such equipment as the ARCO-type travelling wave accelerator, Model Mark I, operating at 3 to 10 million electron volts, such as supplied by High Voltage Engineering Corporation, Burlington, Mass.; a filament-source Electrocurtain system, such as available from Energy Sciences, Inc., Woburn, Mass.; and other accelerators as described in U.S. Pat. No. 2,763,609 and in British Pat. No. 762,953.

In general, the radiation used should be of sufficient strength to penetrate substantially all the way through the polymeric layer and the dosage employed should be adequate to cross-link the polymeric composition to such a degree that the resulting polymer is resistant to heat distortion. The required intensity of the radiation will vary with the thickness of the polymeric coating and the speed at which the coated material is advanced through the irradiation zone.

Unexpectedly, although irradiation of the polymeric support material alone effectively eliminates heat distortion problems, when using a polymeric support comprising a polymeric resin-coated paper, in order to produce the most favorable results, irradiation should be applied to an assembled image-receiving element, rather than simply irradiating the polymeric paper support alone prior to assembly of the image-receiving element. When the support alone is treated, it later develops an undesirable yellowing which becomes evident during the coating and drying steps involved in the application of the remaining diffusion transfer image-receiving element layers. Apparently, the paper core of the resin-clad support contains a trace of aluminum chloride, a residue from the paper manufacturing process. It is surmised that the aluminum chloride is broken down by the radiation treatment to generate aluminum hydroxide and hydrogen chloride. The HCl, in combination with the heat of subsequent drying steps, causes charring of the paper core, resulting in a yellowing degradation of the paper. To avoid this degradation, radiation treatment should be applied to the entire assembled image-receiving element, including the image layer, polymeric acid layer and the time modulating layer, rather than to the uncoated resin-coated paper support itself. However, the presence of the plurality of image-receiving element layers coated on the support introduces additional factors to be considered during irradiation. In general, radiation dosages above about 4 megarads are sufficient to cross-link the polymeric resin to a degree such that distortion at temperatures as high as 325°–400° F. (163°–204° C.) are virtually eliminated; but, at dosages above about 12 megarads, detrimental sensitometric effects begin to be noted. It is surmised that such reduced sensitometry may be caused by radiation-activated breakdown of the polyvinyl alcohol component of the image layer. Radiation dosages of about 5 to about 6 megarads are particularly preferred.

Polymeric resin-coated papers generally include a coating of resin on each side of a paper core. In order to minimize penetration of the radiation into the paper core, it is preferred to irradiate both sides of a resin-coated paper support, independently or sequentially, rather than to increase the strength of the radiation to effect cross-linking of the polymeric coating on both sides of the paper simultaneously from a single radiation source.

The following examples are provided to further illustrate the invention. It will be understood that the examples are intended to be illustrative and not limiting in nature. All parts and percentages are by weight unless otherwise specified.

EXAMPLES I–V

Preparation of irradiated image-receiving elements

Using commonly prepared image-receiving element material, a series of irradiation runs was conducted using varying radiation dosages sufficient to cross-link the polyethylene component of the support material, according to the present invention. This series of runs, designated as Examples I–V, applied radiation dosages of 4, 5, 6, 7 and 9 megarads, respectively.

The diffusion transfer photographic image-receiving element material was prepared by coating a sheet of polymeric support with successive layers comprising a polymeric acid layer, a time modulating layer, an image-receiving layer and a stripping layer. The polymeric support was a polyethylene clad paper comprising a 5.0 mil (0.13 mm) thick, high strength paper coated on each side with a white, $TiO_2$-pigmented layer of polyethylene having a thickness of 2.0 mil (0.05 mm); the successive layers respectively comprised the following major ingredients:

1. A mixture of about 8 parts, by weight, of a partial butyl ester of polyethylene/maleic anhydride and about 1 part, by weight, of polyvinyl butyral resin (Butvar, Shawinigan Products, New York, N. Y.) to form a polymeric acid layer approximately 0.6 to 0.9 mils (0.01–0.02 mm) thick;
2. a mixture of about 7 parts, by weight, of hydroxypropyl cellulose (Klucel, J12HB, Hercules, Inc., Wilmington, Delaware), and about 4 parts, by weight, of polyvinyl alcohol; to form a spacer layer approximately 0.30 to 0.37 mils (0.008–0.009 mm) thick;
3. a mixture of about 2 parts of polyvinyl alcohol and 1 part of poly-4-vinylpyridine to form an image-receiving layer approximately 0.35 to 0.45 mils (0.009–0.011 mm) thick, also containing an equimolar mixture of the cis- and trans-isomers of 4,5-cyclopenthahexahydropyrimidine-2-thione (described in U.S. Pat. No. 3,785,813 issued to D. O. Rickter on Jan. 15, 1974) as a development restraining reagent, and hardened by a condensate of acrolein and formaldehyde.
4. a stripping layer formed by coating a gum arabic-/ammonia solution (about 2 parts, by weight, ammonium hydroxide) at a total solids coverage of about 16 mgs/ft$^2$ (172 mg/m$^2$).

The radiation employed to treat the image-receiving element material was a curtain of ionizing radiation from a wire-filament electron source, available as the Electrocurtain System from Energy Sciences, Inc., Woburn, Mass. The electron beams from the wire-filament source were passed through a beam window in a shielding cylinder and onto a continuously advancing web of image-receiving element material at a distance from the wire-filament source to the moving web of 6.0 inches (15.2 cm). The distance from the web to the radiation beam window was 1.5 inches (3.8 cm ). The radiation source was operated at a current of 90 milliamperes at a potential of 150,000 volts. Dosages were regulated by adjusting the speed of the web passing under the radiation source (e.g. 145 ft/min (44.2 m/min)=4 megarads, 97 ft/min (29.6 m/min)=6 megarads, etc.). Both sides of the webs were irradiated by first exposing one side of a web and exposing the reverse side in the same manner.

A portion of the image-receiving element sheet was left nonirradiated and maintained as a control.

EXAMPLES VI–X

Film Unit Assembly-Testing and Evaluation

To evaluate the effects of irradiating image-receiving element material based on a polymeric support, diffusion transfer film units were assembled, including irradiated image-receiving elements. These film units, designated as Examples VI–X, were prepared using the irradiated image-receiving element material of Examples I–V, respectively. Control film units, assembled utilizing nonirradiated image-receiving elements, were prepared for purposes of comparison.

The photosensitive elements of the film units were prepared by coating, in succession, on a gelatin-subcoated 4.0 mil (0.10 mm) thick opaque cellulose triacetate film base, the following layers:

1. a layer comprising the cyan dye developer:

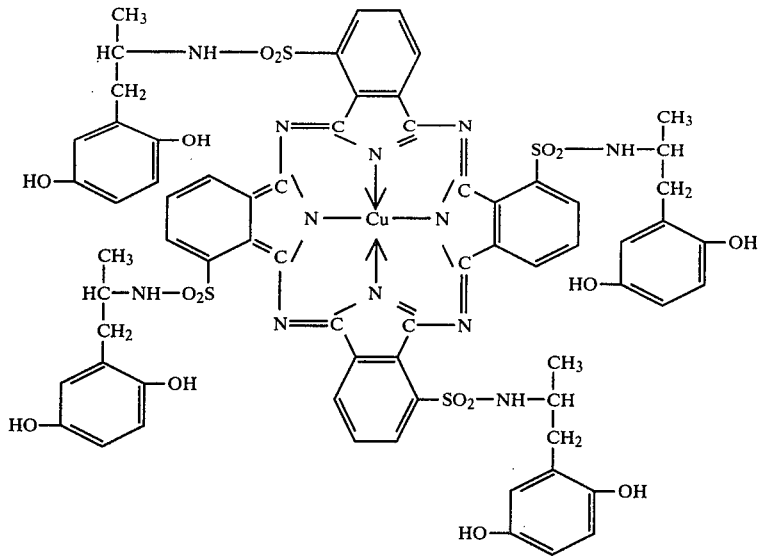

dispersed in gelatin and coated at a coverage of about 69 mgs/ft$^2$ (743 mg/m$^2$) of dye and about 98 mgs/ft$^2$ (1055 mg/m$^2$) of gelatin;

2. a red-sensitive gelatino silver iodobromide emulsion layer coated at a coverage of about 140 mgs/ft$^2$ (1507 mg/m$^2$) of silver and about 61 mgs/ft$^2$ (657 mg/m$^2$) of gelatin;
3. an interlayer of a 60-30-4-6 copolymer of butylacrylate, diacetone acrylamide, styrene and methacrylic acid plus about 2.4% by weight of polyacrylamide permeator, coated at about 180 mgs/ft$^2$ (1938 mg/m$^2$) of total solids;
4. a layer comprising the magenta dye developer:

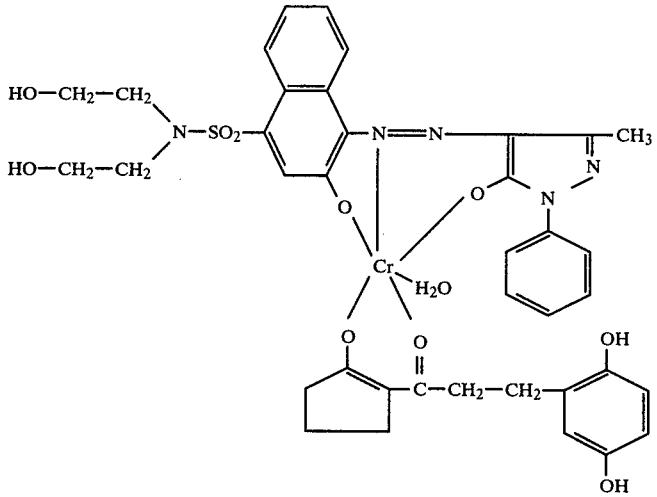

dispersed in gelatin and coated at a coverage of about 75 mgs/ft$^2$ (807 mg/m$^2$) of gelatin;

5. a green-sensitive gelatino silver iodobromide emulsion layer coated at a coverage of about 80 mgs/ft$^2$ (861 mg/m$^2$);
6. a layer containing the copolymer referred to above in layer 3 plus about 7.8% polyacrylamide coated at about 107 mgs/ft$^2$(1152 mg/m$^2$) of total solids; and also containing succindialdehyde as a hardener at about 9.8 mgs/ft$^2$ (105 mg/m$^2$);
7. a layer comprising the yellow dye developer;

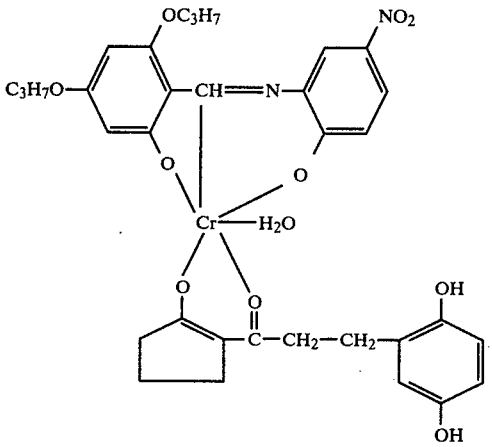

dispersed in gelatin and coated at a coverage of about 83/mgs/ft$^2$ (893 mg/m$^2$) of dye and about 58 mgs/ft$^2$ (624 mg/m$^2$) of gelatin;

8. a blue-sensitive gelatino silver iodobromide emulsion layer coated at a coverage of about 120 mgs/ft$^2$ (1292 mg/m$^2$) of silver and about 53 mgs/ft$^2$ (570 mg/m$^2$) of gelatin, plus about 30 mgs/ft$^2$ (323 mg/m$^2$) of 4'-methylphenylhydroquinone and 34 mgs/ft$^2$ (366 mg/m$^2$ of gelatin;
9. a gelatin overcoat layer coated at a coverage of about 40 mgs/ft$^2$ (431 mg/m$^2$) of gelatin.

A rupturable container comprising an outer layer of lead foil and an inner liner or layer of polyvinyl chloride retaining an aqueous alkaline solution comprising the following basic formulation:

| | | |
|---|---|---|
| Potassium hydroxide (pellets of 85% KOH) | 10.35 | g. |
| Sodium carboxymethyl cellulose Hercules Type 7H4F) | 3.00 | g. |
| N-phenethyl-αpicolinium bromide | 2.07 | g. |
| Benzotriazole | 3.15 | g. |
| 5-bromo-6-methyl-4-azabenzimidazole | 0.40 | g. |
| 6-methyl uracil | 0.70 | g. |
| Bis-(β-aminoethyl)-sulfide | 0.90 | g. |
| Zinc nitrate | 0.50 | g. |
| Potassium iodide | 0.0018 | g. |
| Lithium nitrate | 0.45 | g. |
| Water | 100 | ml. |

was affixed to the leading edge of the film units such that upon application of compressive pressure to the container, its contents were distributed, upon rupture of the container's marginal seal, between the surface layer of the photosensitive and receiving elements.

Each of the test photosensitive elements were exposed through a xenon sensitometry unit to light in columns of yellow, green and red ranges of the visible spectrum. The exposures were adjusted to provide a segment of maximum exposure of two meter candle seconds and minimum exposure of zero. Each photosensitive unit was then processed by spreading the above-described processing composition between the exposed photosensitive element and the respective test image-receiving element as the two elements were brought into superposed relationship between a pair of pressure-applying rollers. Each example included a series of photoexposures with processing conducted under controlled conditions for environmental situations of 55° F. (13° C.), 75° F. (24° C.) and 95° F. (35° C.). Imbibition times were adjusted according to temperature: 13° C.–90 sec; 24° C.–60 sec; and 35° C.–60 sec.

Following the prescribed imbibition period, each image-receiving element was separated from the remainder of its film unit, and, after it was allowed to dry, the image-receiving element was sensitometrically evaluated using a densitometer to determine reflection density. The blue Dmin reading of all the test elements of Examples VI–X, employing irradiated image-receiving elements, averaged a negligible 0.01 higher than the nonirradiated control samples. The green and red Dmin readings evidenced no appreciable change. The Dmax readings for each of the irradiated test samples and the controls were also equivalent, excepting that at 13° C. all the irradiated samples exhibited 0.05 to 0.08 lower Dmax readings for red, green and blue than the controls.

The test film units of Examples VI–X also were used to photograph standardized model scenes using a Polaroid Land Camera and the resultant images were visually examined for color balance, saturation and isolation characteristics. There was no observable difference between the resulting image-bearing elements of the irradiated test samples and the controls using nonirradiated image elements.

To appraise distortion effect at high temperatures, a grid pattern consisting of a series of intersecting lines, each line having a width of about 5.0 mils (0.13 mm) was drawn on the image surface of an image-receiving element from a film unit which had been exposed and processed at 75° F. (24° C.) separated, and dried overnight. The grid-bearing element was then laminated between two sheets of vinyl in a Polaroid PolaPress laminator, using a heated platen at about 70 psi (4.9 kg/m$^2$) and a temperature of about 350° F. (177° C.). After lamination, the element was visually checked for distortion by superposing a grid overlay over the previously drawn grid pattern. The overlay pattern had line widths of about 6.0 mils (0.15 mm). Any grid misalignment constituted sample failure. Image-receiving elements representing Examples VI–X were evaluated for heat distortion effect in this manner. While each of the control samples based on nonirradiated supports exhibited notable distortion, all of the test image elements using irradiated supports showed no such temperature effect.

EXAMPLES XI–XIV

To explore the sensitometric effect of increasing radiation dosages, a second series of irradiation runs was conducted, using the same procedures and image-receiving element material as described in Examples I–V above. This series of runs, designated Examples XI–XIV, applied radiation dosages of 3,5,9 and 12 megarads, respectively. A portion of the image-receiving element material was left nonirradiated and maintained as a control.

Film units were prepared from the test image element material and sensitometry evaluation at 24° C. was performed using the procedure outlined in Examples VI–X above. The resulting image-bearing element corresponding to Examples XI, XII and XIII, with respective irradiation dosages of 3, 6 and 9 megarads, evidenced no appreciable sensitometry effect; the image-bearing element of Example XIV, with a 12 megarad dosage, revealed a Dmax loss of about 0.05 (red, blue and green) at 24° C., as compared with the control.

Use of the present invention permits the unrestricted utility of polymeric photographic supports for image-receiving elements in diffusion transfer film units. In ID card preparation where high temperature lamination means are employed to seal the card, a diffusion transfer print based on an irradiated polymeric support, according to the present invention, will resist undesirable distortion.

Although the invention has been particularly described with reference to preferred embodiments thereof, it will be understood that various alterations may be made therein without departing from the spirit and scope of the invention. For example, if found to be advantageous, the polymeric support material may be irradiated alone, while part of a fully assembled image-receiving element, or at any stage during the layer application procedures involved in preparing an image-receiving element. Alternatively, rather than irradiate the support material preceding, during or following assembly of the image-receiving element, a developed diffusion transfer print may be irradiated as well without adversely affecting the quality of the developed image.

Radiation treatment of polymeric support material also may be useful to eliminate the effects of heat encountered in processing or handling procedures other than ID card lamination, such as the heat of drying steps involved in various coating operations. In addition, the irradiated support may be employed in any suitable photographic film structure and is not restricted to use in diffusion transfer photographic elements.

What is claimed is:

1. In a method for preparing a photographic image-bearing element, based on a polymeric support sheet comprising a polyethylene material, the improvement comprising subjecting said support sheet to ionizing irradiation sufficient to penetrate substantially through the support and crosslink the polyethylene material to stabilize said photographic image-bearing element from the distortion effects of high temperatures.

2. The method of claim 1 for preparing a diffusion transfer photographic image-receiving element, based on a polymeric support material.

3. The method of claim 2 for preparing a diffusion transfer photographic image-receiving element by coating a polymeric acid layer, a time modulating layer and an image layer on one surface of a polymeric support material.

4. The method of claim 3 wherein said polymeric support is a polyethylene coated paper.

5. The method of claim 4 comprising subjecting said image-receiving element based on polyethylene coated paper support to irradiation.

6. The method of claim 3 wherein said ionizing radiation is electron beam radiation.

7. The method of claim 6 comprising subjecting said image-receiving element based on a polyethylene coated paper support to electron beam radiation in a dosage ranging from about 4 to about 12 megarads.

8. The method of claim 7 wherein said dosage ranges from about 5 to about 6 megarads.

9. The method of claim 7 wherein said polyethylene coated paper, comprising a paper core clad on each side with a layer of polyethylene, is irradiated independently on each side.

10. A photographic image-bearing element, based on a polymeric support sheet, said polymeric support comprising a polyethylene material stabilized from the distortion effects of high temperatures by treating said support sheet with ionizing irradiation sufficient to penetrate substantially through the support and cross-link the polyethylene material.

11. The photographic element of claim 10 comprising a diffusion transfer photographic image-receiving element.

12. The photographic element of claim 11 comprising a diffusion transfer image-receiving element based on an irradiated polyethylene coated paper support.

13. The photographic element of claim 12 comprising a polymeric acid layer, a time modulating layer and an image based on an irradiated polyethylene coated paper support.

* * * * *